US011027946B2

(12) United States Patent
Turek et al.

(10) Patent No.: US 11,027,946 B2
(45) Date of Patent: Jun. 8, 2021

(54) BELT-DRIVEN PEOPLE CONVEYORS

(71) Applicant: Otis Elevator Company, Farmington, CT (US)

(72) Inventors: Alexander Turek, Münchendorf (AT); Thomas Illedits, Neufeld an der Leitha (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/891,717

(22) Filed: Jun. 3, 2020

(65) Prior Publication Data

US 2020/0385238 A1 Dec. 10, 2020

(30) Foreign Application Priority Data

Jun. 4, 2019 (EP) ..... 19178247

(51) Int. Cl.

| | |
|---|---|
| ***B66B 21/04*** | (2006.01) |
| ***B66B 23/02*** | (2006.01) |
| ***B66B 23/12*** | (2006.01) |
| ***B66B 23/14*** | (2006.01) |

(52) U.S. Cl.

CPC ..... *B66B 21/04* (2013.01); *B66B 23/026* (2013.01); *B66B 23/12* (2013.01); *B66B 23/145* (2013.01)

(58) Field of Classification Search

CPC ..... B66B 21/10; B66B 7/062; B66B 23/024; B66B 23/028; B66B 21/04; B66B 23/026; B66B 23/12; B66B 23/145

USPC ..... 198/321

See application file for complete search history.

(56) References Cited

U.S. PATENT DOCUMENTS

| | | | | |
|---|---|---|---|---|
| 7,063,202 | B2 * | 6/2006 | Ossendorf | B66B 21/10 198/321 |
| 7,168,547 | B2 | 1/2007 | Thaler et al. | |
| 7,219,784 | B2 | 5/2007 | Fargo | |
| 7,353,932 | B2 | 4/2008 | Aulanko et al. | |
| 9,862,575 | B2 | 1/2018 | Schulz et al. | |
| 10,035,681 | B2 * | 7/2018 | Turek | B66B 23/024 |
| 10,214,390 | B2 | 2/2019 | Doi | |
| 10,683,192 | B2 * | 6/2020 | Michalke | B66B 23/024 |

(Continued)

FOREIGN PATENT DOCUMENTS

| | | | |
|---|---|---|---|
| CN | 101746661 | B | 1/2012 |
| CN | 103130083 | A | 6/2013 |
| CN | 203976201 | U | 12/2014 |

(Continued)

OTHER PUBLICATIONS

European Search Report for application 19178247.3, dated Nov. 28, 2019, 8 pages.

(Continued)

*Primary Examiner* — James R Bidwell

(74) *Attorney, Agent, or Firm* — Cantor Colburn LLP

(57) ABSTRACT

A conveyance element 2 for a belt-driven people conveyor is provided which comprises a first belt connection structure 12 arranged to connect a drive belt 108 to the conveyance element 2, and a second belt connection structure 14 arranged to connect the drive belt 108 to the conveyance element 2. The first and second belt connection structures 12, 14 are arranged such that, when connected, the drive belt 108 passes adjacent to and between the first and second belt connection structures 12, 14.

14 Claims, 8 Drawing Sheets

(56) References Cited

U.S. PATENT DOCUMENTS

| | | | | |
|---|---|---|---|---|
| 2005/0279611 | A1* | 12/2005 | Ossendorf | B66B 23/02 198/321 |
| 2006/0266617 | A1* | 11/2006 | Mustalahti | B65G 17/18 198/321 |

FOREIGN PATENT DOCUMENTS

| | | | |
|---|---|---|---|
| CN | 105438949 | A | 3/2016 |
| CN | 109641724 | A | 4/2019 |
| DE | 1816611 | A1 | 7/1970 |
| EP | 1142824 | A1 | 10/2001 |
| EP | 1322540 | A2 | 7/2003 |
| EP | 1347933 | A1 | 10/2003 |
| EP | 1502891 | A1 | 2/2005 |
| EP | 1597185 | A1 | 11/2005 |
| EP | 1680329 | A2 | 7/2006 |
| EP | 1680347 | A1 | 7/2006 |
| EP | 1711427 | A2 | 10/2006 |
| EP | 1597186 | B1 | 6/2009 |
| EP | 2341028 | A1 | 7/2011 |
| EP | 1513759 | B1 | 11/2011 |
| EP | 2546183 | A1 | 1/2013 |
| EP | 1440031 | B1 | 9/2013 |
| EP | 2702292 | A1 | 3/2014 |
| EP | 2900586 | A1 | 8/2015 |
| EP | 2928807 | A1 | 10/2015 |
| EP | 3024771 | A1 | 6/2016 |
| EP | 3060511 | | 8/2016 |
| EP | 3257804 | A1 | 12/2017 |
| EP | 3283426 | B1 | 1/2019 |
| EP | 3473575 | A1 | 4/2019 |
| GB | 2195604 | A | 4/1988 |
| JP | 2006327698 | A | 12/2006 |
| WO | 2004046012 | A1 | 6/2004 |

OTHER PUBLICATIONS

Author Unknown; "Elevators & Escalators: Escalator Structure and Equipment"; Mitsubishi Electric Corporation; 3 Pages. https://www.mitsubishielectric.com/elevator/overview/e_m_walks/e_s_equipment.html.

Author Unknown; "Escalators Basic Components—Part Two" Electrical Knowhow: MISUMI Linear Motion Parts; 2013;16 Pages. http://www.electrical-knowhow.com/2012/04/escalators-basic-components-part-two.html.

* cited by examiner

BELT-DRIVEN PEOPLE CONVEYORS

FOREIGN PRIORITY

This application claims priority to European Patent Application No. 19178247.3, filed Jun. 4, 2019, and all the benefits accruing therefrom under 35 U.S.C. § 119, the contents of which in its entirety are herein incorporated by reference.

TECHNICAL FIELD

The present disclosure relates to belt-driven people conveyors such as moving walkways and escalators.

BACKGROUND

Conventional people conveyors comprise a set of conveyance elements (e.g. escalator steps or moving walkway pallets) on which passengers stand that are propelled by a drive system to convey the passengers from one place to another (e.g. between floors of a building). The conveyance elements are typically connected to an endless conveyance element chain (e.g. an escalator step chain) made up of multiple chain links that passes over a drive sprocket. The drive sprocket is rotated by the drive system (typically via a drive chain), driving the conveyance element chain to pull the conveyance elements along (e.g. up or down inclined guide tracks). Each conveyance elements is carried in a continuous loop by the conveyance element chain, carrying passengers from one end of the people conveyor to the other (e.g. up an incline), before looping back.

Over the lifetime of the people conveyor, the pins and sockets that connect links of the conveyance element chain can become worn, leading to a potentially dangerous elongation of the conveyance element chain. It is, therefore, desirable to utilise as few links as possible in a conveyance element chain, to reduce the magnitude of wear-induced elongation. However, reducing the number of links reduces ride comfort and requires a larger sprocket to drive the conveyance element chain. A larger drive sprocket requires a higher torque from the drive system and takes up additional space, increasing the footprint of the people conveyor system. An alternative approach is desired.

SUMMARY

According to a first aspect of the present disclosure there is provided a conveyance element for a belt-driven people conveyor comprising: a first belt connection structure arranged to connect a drive belt to the conveyance element; and a second belt connection structure arranged to connect the drive belt to the conveyance element; wherein the first and second belt connection structures are arranged such that, when connected, the drive belt passes adjacent to and between the first and second belt connection structures.

The present disclosure extends to a belt-driven people conveyor comprising: a plurality of conveyance elements each comprising first and second belt connection structures; and a drive belt connected to the plurality of conveyance elements via the first and second belt connection structures, wherein the drive belt passes adjacent to and between the first and second belt connection structures.

Because the belt is adjacent to and between the first and second belt connection structures of the conveyance element (s) when it is connected to the conveyance element (i.e. with the first and second belt connection structures on either side of the belt), a driving force on the conveyance element(s) from the drive belt is applied evenly, e.g. without twisting the drive belt and/or without different sections of the drive belt experiencing different levels of tension.

The conveyance element may be arranged to convey passengers along a conveyance path of the people conveyor. The conveyance path may be flat or non-inclined (or only gently inclined) with the conveyance elements remaining substantially flush throughout the conveyance path (e.g. a moving walkway, sometimes referred to as a travellator). However, in some preferred examples the conveyance path may comprise an inclined region in which the adjacent conveyance elements separate from one another to form a stepped region (e.g. the people conveyor may be an escalator arranged to convey passengers up or down an incline). The people conveyor may comprise at least one step track (or equivalently a pallet track, in examples where the people conveyor comprises a moving walkway) which follows the conveyance path, along which the conveyance element is arranged to travel during passenger conveyance. The conveyance element may comprise one or more step rollers (or pallet rollers) arranged to support the conveyance element on the step track. Preferably the people conveyor comprises two parallel step tracks and the conveyance element comprises two corresponding step rollers on opposite sides of the conveyance element. Using two step tracks helps to keep the conveyance elements level during passenger conveyance.

In examples where the conveyance path comprises an inclined region (e.g. where the people conveyor comprises an escalator), the conveyance path may also comprise at least one non-inclined region (i.e. a region in which the conveyance elements travel substantially parallel to the ground). For example, the conveyance path may comprise a non-inclined landing region at one or both ends of the conveyance path to facilitate passenger embarkation or disembarkation. In some such examples, the conveyance path may comprise a transition region between the inclined region and the landing region in which the conveyance elements transition from travelling at an incline to travelling parallel to the ground in the non-inclined landing region. In such examples, the step track may comprise an inclined section, a non-inclined landing section and a curved transition section corresponding to the transition region to facilitate a smooth transition between inclined and horizontal travel of the conveyance elements.

The people conveyor preferably comprises a drive system coupled to the drive belt, which is arranged to drive the belt so as to propel the plurality of conveyance elements. The drive system may comprise a drive motor (e.g. an electric motor) and a drive sprocket or pulley coupled to the drive motor, configured to engage the drive belt. In such examples, the drive sprocket or pulley is rotated by the drive motor to transmit driving force from the drive motor to the drive belt.

In some examples the drive belt may be toothed (i.e. the drive belt may comprise a plurality of teeth configured to engage corresponding teeth of a drive sprocket). A toothed drive belt in conjunction with a drive sprocket may enable a high amount of drive force to be transmitted from a drive motor to the conveyance elements. The teeth also reduce or even avoid slippage. The drive belt preferably comprises a substantially flat belt, i.e. with a width that is greater than its thickness (width being the dimension perpendicular to the direction of drive and parallel to the axis of rotation of the drive sprocket).

The use of a flexible drive belt (rather than a step chain), reduces the risk of elongation, because there are no link connections that can wear over time. The number of teeth that may be provided on a drive belt is not limited by elongation considerations and a toothed drive belt may therefore be provided with more teeth per unit length than links of an equivalent step chain. This may result in a smoother ride quality (i.e. a more comfortable ride) and a more distributed drive load on the drive sprocket (i.e. with a lower force needing to be transmitted through each tooth of the drive sprocket). A drive belt may also require no lubrication and can reduce the noise produced by the people conveyor.

Preferably, the drive belt comprises four or more teeth between each conveyance element, and further preferably the drive belt comprises five or more teeth per conveyance element, e.g., seven or more, ten or more or even fifteen or more teeth per conveyance element. Preferably, the drive sprocket comprises more than 16 teeth, and may comprise up to 20 teeth or more, e.g., 22 teeth or more.

The drive belt may comprise a polyurethane and/or rubber material, such as ethylene propylene rubber (EPDM). The drive belt may comprise reinforcing longitudinal strands (e.g. comprising steel, stainless steel, carbon and/or aramid fibre). The reinforcing strands may be embedded in the polyurethane and/or rubber material of the drive belt.

The radius of a conventional drive sprocket for a step chain is normally constrained by the size and properties of the links of the step chain (the minimum radius is determined by the length and maximum articulation angle of each link). In a typical people conveyor system comprising three chain links per step, the necessary sprocket radius is large, requiring a large drive torque and increasing the space taken up by the people conveyor system. However, when a flexible drive belt is used many of these constraints do not apply and the radius of the drive sprocket can be reduced. This accordingly reduces the torque required to drive the belt and also reduces the footprint of the people conveyor (both due to the smaller sprocket itself and the possible removal of intermediate gears or drive chains between the motor and the drive sprocket as a result of the reduced torque requirements). In some preferred examples, the drive system may comprise a direct drive system, in which a drive motor is coupled directly to the drive sprocket (e.g. without a separate gearbox or gearing assembly requiring a drive chain). Preferably, the drive sprocket has a diameter of less than 700 mm and may have a diameter of 500 mm or less, e.g. 300 mm or less.

A reduction in sprocket radius (and/or the use of a direct drive system) may enable the sprocket (and possibly even the whole drive system) to be located partially or entirely within the footprint of the conveyance elements of the people conveyor (e.g. below a landing region of an escalator). Thus, in contrast to conventional people conveyors where the step chain travels alongside the conveyance elements, in some examples of the present disclosure the drive belt may travel below the conveyance elements (e.g. in line with a drive sprocket located below a landing region of an escalator). This may reduce the truss width of the people conveyor. The use of a drive belt and optionally a direct drive system can reduce the truss width compared to conventional people conveyors by up to 50 mm or more and even up to 100 mm or more.

The conveyance element preferably comprises a tread surface on which passengers stand whilst they are conveyed. The tread surface preferably comprises an upper surface of the conveyance element (i.e. an upper surface whilst the conveyance element is carrying passengers—the conveyance elements may loop back in a different orientation). The tread surface is preferably substantially planar, although it may comprise a series of ridges or grooves extending perpendicular to the surface.

To provide a safe and comfortable ride to passengers, the conveyance element is preferably arranged such that the tread surface maintains a constant orientation (e.g. horizontal) throughout passenger conveyance. In some examples, this may require the orientation of the conveyance element to change relative to the drive belt during operation, for example as the conveyance elements transition from an inclined region of the people conveyor to a flat (i.e. horizontal) landing region of the people conveyor. In some examples, therefore, the first and/or second belt connection structures are arranged to rotatably connect the drive belt to the conveyance element (i.e. such that it can rotate about an axis perpendicular to the direction of drive but parallel to a tread surface). Connecting the belt such that it can rotate relative to the conveyance element enables the drive direction of the belt to change without changing the orientation of the conveyance element. For example, rotatably connecting the drive belt enables the conveyance element to be driven along a curved transition region whilst the conveyance element's orientation remains constant relative to the ground (e.g. with a tread surface of the conveyance element remaining horizontal).

Such a connection may be achieved with a simple pin/hole assembly (e.g. wherein the first and/or second belt connection structure comprises a pin structure associated with a corresponding hole on the belt, or vice versa where the first and/or second belt connection structure comprises a hole associated with a corresponding pin on the belt). Alternatively, the first and/or second belt connection structure may comprise a bearing (e.g. a plain bearing, a bushing or a ball/roller bearing). This may facilitate low friction rotation of the belt relative to the conveyance element.

The first and/or second belt connection structure may be arranged to directly connect the drive belt to the conveyance element (e.g. via a pin/hole arrangement as described above). However, in some examples the first and/or second belt connection structure may be arranged to connect the drive belt to the conveyance element using a belt connection member. For example, the drive belt may be arranged to be connected (e.g. via bolts) to a belt connection member which is in turn connected to the first and/or second belt connection structure. The belt connection member may comprise an axle that is supported by a bearing of the first and/or second belt connection member. The belt connection member may comprise a plate that is connected to the drive belt and to both the first and second belt connection members.

In some examples, the first and/or second belt connection structure is located below the tread surface of the conveyance element. For example, the first and/or second belt connection structure may be provided in a lower region of the conveyance element (e.g. extending from a lower edge of the conveyance element).

The conveyance element may comprise a first support component arranged to support the conveyance element as it conveys passengers. The people conveyor may comprise a first support track (e.g. in addition to the step track), on which the first support component is arranged to support the conveyance element. The first support track preferably extends along the entire conveyance path and preferably extends parallel to the step track in at least some places (e.g. in an inclined region). The step track, the first support track, the step roller and the first support component are preferably arranged such that the tread surface of the conveyance element is oriented horizontally throughout passenger conveyance along the conveyance path. In a preferred example, the step roller may be positioned in an upper region of the conveyance element (e.g. at the top of the conveyance element), and the first support component may be positioned in a lower region of the conveyance element (e.g. at the bottom of the conveyance element).

The positions of the step roller and the first support component on the conveyance element are preferably fixed. In some such examples, to ensure that the orientation of the conveyance element remains constant (e.g. horizontal) throughout passenger conveyance (e.g. as it travels through an inclined region, a transition region and a landing region), the step and first support tracks may diverge (i.e. not extend parallel) in at least some regions of the conveyance path. For example, the first support track and the step track may diverge in a transition region.

In a preferred set of examples, the first support component may be located near to the first belt connection structure. The first support component may be connected to the first belt connection structure. The first support component may comprise a belt roller. In some such examples, the belt roller is connected to the first belt connection structure via a bushing or bearing, to allow free rotation relative to the drive belt and the conveyance element. In some examples, the belt roller comprises an axis of rotation in the plane of the drive belt but perpendicular to the direction of drive. The belt roller is preferably arranged such that its axis of rotation passes through the drive belt when it is connected, preferably through a centre of drive force of the drive belt (e.g. halfway through a thickness of the drive belt). Arranging the belt roller such that its rotation axis is near to or aligned with the centre of drive force reduces or even eliminates the application of off-axis forces (i.e. a moment) to the belt roller and/or the belt connection structure.

As mentioned above, the conveyance path may comprise a transition region in which the conveyance elements transition from travelling at an incline to travelling horizontally (or vice-versa). In this region the first support track may come under an increased load due to tension in the drive belt. Whilst in some examples the first support track may be arranged to provide sufficient support to the conveyance elements in all regions of the people conveyor, this either requires the first support track to be unnecessarily strong elsewhere (e.g. in an inclined region which does not require a large support force from the first support track), or for the first support track to have a complex structure which provides varying amounts of strength in different regions, adding to manufacturing expense.

In some examples, therefore, the conveyance element may comprise a second support component arranged to support the conveyance element on a second support track. The second support track preferably extends parallel to the first support track, but for only part of the conveyance path (e.g. substantially in only the transition region). The second support component may therefore provide additional support where it is required, avoiding the need for an unnecessarily strong step roller/track or first support component/track. The step roller/track and/or first support component/track may be configured to provide the amount of support required in non-transition regions of the conveyance path, with the second support component/track configured to provide any extra support required in the transition region.

The second support component may be located near to the second belt connection structure and may be connected thereto. The second support component may comprise a belt roller that may be connected to the second belt connection structure via a bushing or bearing, optionally with its axis of rotation arranged to pass through the drive belt, when it is connected. In some preferred examples, the first support component comprises a first belt roller connected to the first belt connection structure via a bearing (e.g. a roller bearing) and the second support component comprises a second belt roller connected to the second belt connection structure via a bushing. The use of a bearing may reduce resistive friction forces on the first belt roller (which is in use throughout the entire conveyance path). A bushing may be particularly suitable for the second belt roller, because of the small space consumption and high robustness of a bushing. A bushing may be more tolerant of increased load (i.e. the excess load taken up by the second belt roller) and may be less expensive than a bearing. However, in some examples a second belt roller connected to the second belt connection via a ball bearing might also be suitable. In such examples, the second belt roller may have a smaller radius than the first belt roller.

In some examples one or more intermediate belt rollers may be connected to the drive belt between adjacent conveyance elements. The provision of intermediate belt rollers may provide additional support to the conveyance elements as they convey passengers and/or may reduce bending forces on the drive belt (e.g. in a transition region). This can increase the lifetimes of various components of the people conveyor, such as belt rollers (as the load is spread over a larger number of rollers) and/or the drive belt (as it experiences less severe bends).

The intermediate belt rollers may be arranged to travel along the first and/or second support tracks. For example, an intermediate first belt roller may be connected to the drive belt between (e.g. halfway between) a first belt roller of a first conveyance element and a first belt roller of a second, adjacent, conveyance element. In examples featuring a second support component (e.g. a second belt roller), an intermediate second belt roller may be connected to the drive belt between (e.g. halfway between) a second support component of a first conveyance element and a second support component of a second, adjacent, conveyance element.

The conveyance element may comprise only one pair of first and second belt connection structures (e.g. positioned in the centre of the conveyance element or towards one side of the conveyance element). However, in some sets of examples the conveyance element may comprise two pairs of first and second belt connection structures, each pair arranged to connect a drive belt to the conveyance element (i.e. one drive belt per pair of support components) such that, when connected, each drive belt passes adjacent to and between the first and second belt structures with which it is connected to the conveyance element.

Providing two pairs of belt connection structures for use with two drive belts can increase the load capacity of the people conveyor and/or provide redundancy in case of damage or breakage to one of the drive belts. The optional features outlined above with respect to the first and second belt connection structures may also apply to one or both pairs of belt connection structures in examples featuring two pairs of belt connection structures.

More generally, features of any example described herein may, wherever appropriate, be applied to any other example described herein. Where reference is made to different examples or sets of examples, it should be understood that these are not necessarily distinct but may overlap.

DRAWING DESCRIPTION

Certain examples of the present disclosure will now be described with reference to the accompanying drawings in which.

and

Figure 14:
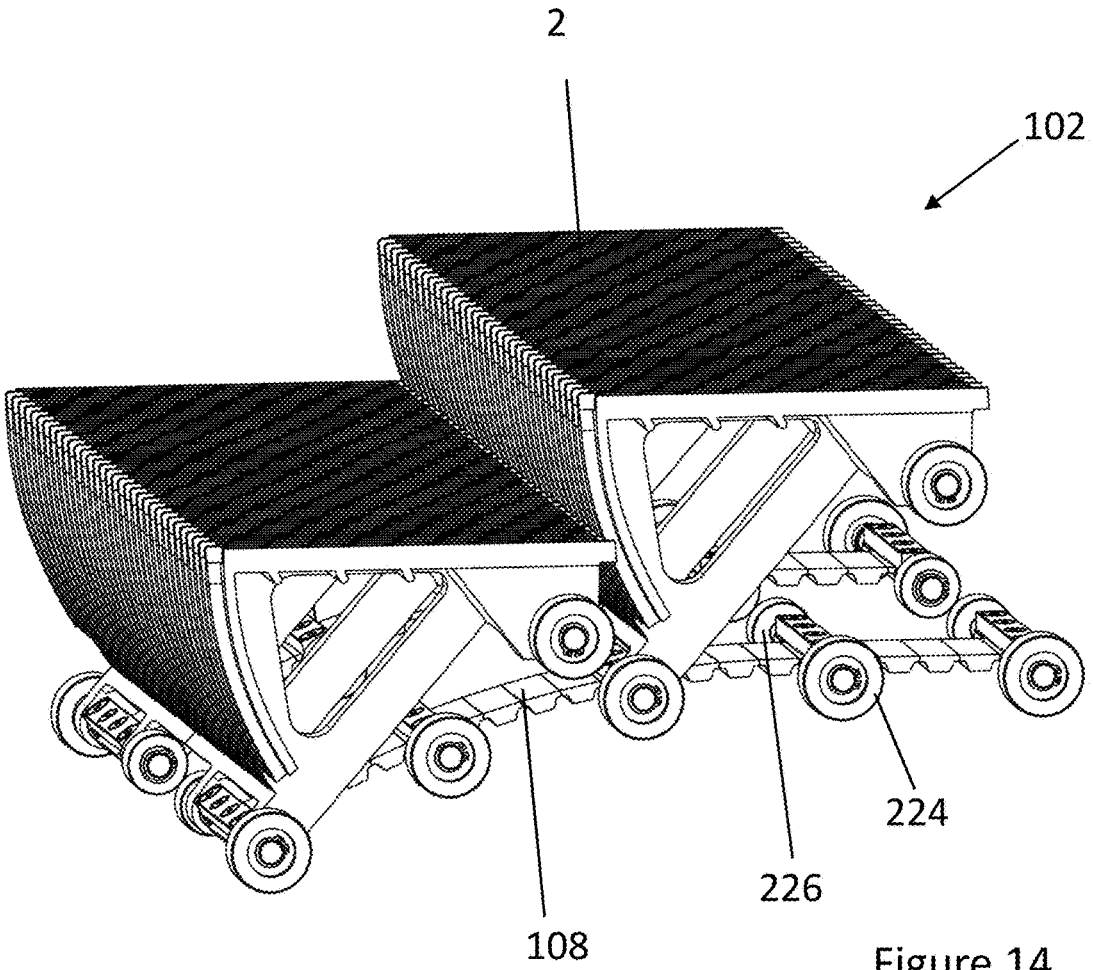
Figure 15:
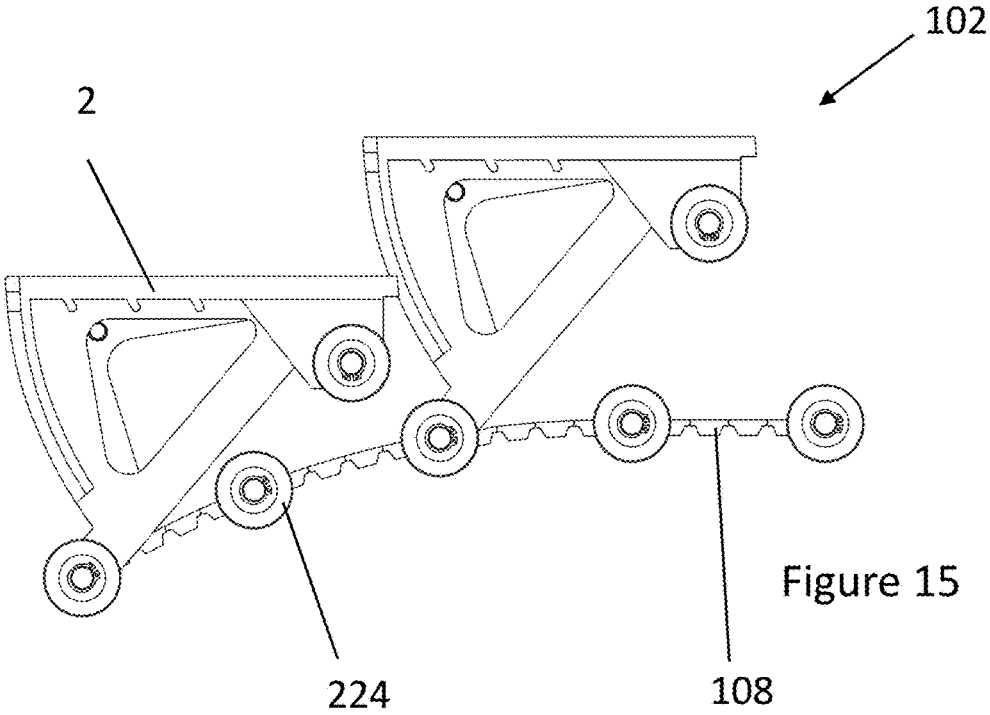

FIGS. 14 and 15 illustrate a people conveyor with intermediate belt rollers.

DETAILED DESCRIPTION

Figure 1:
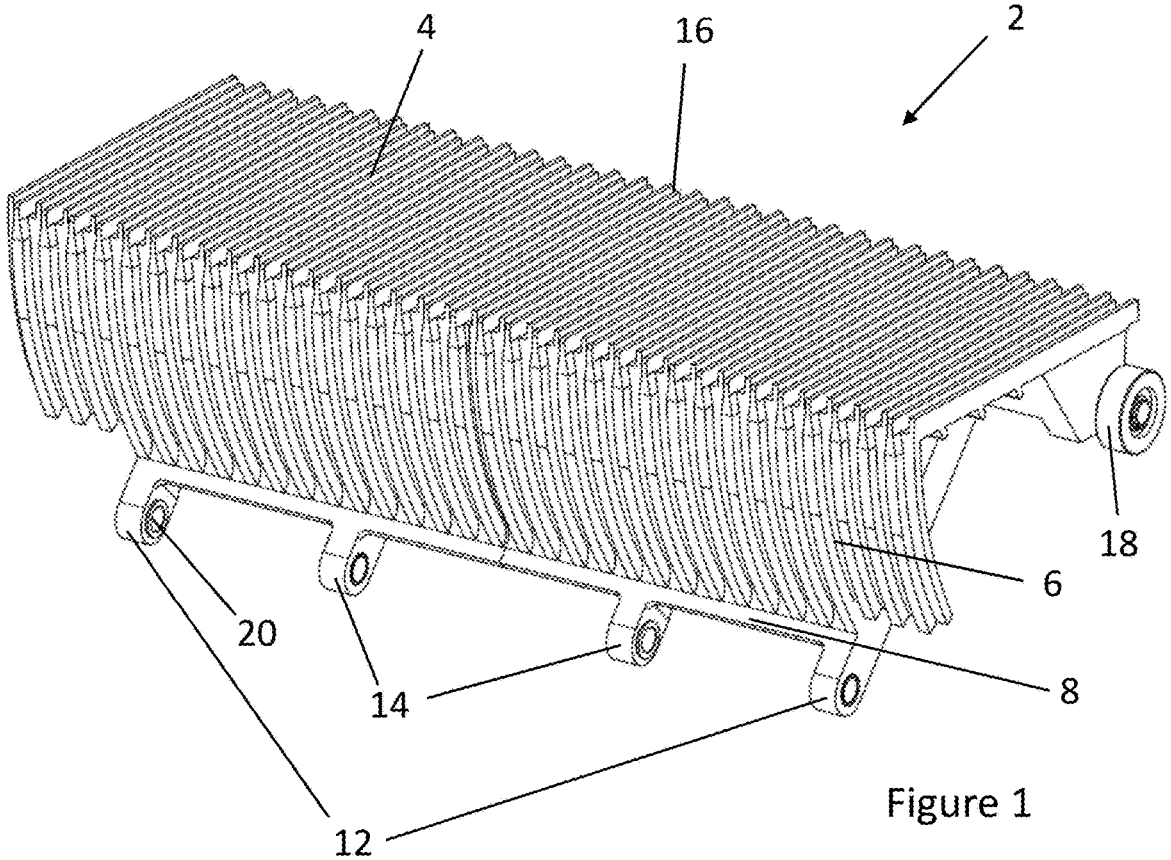
FIG. 1 shows a conveyance element in accordance with an example of the present disclosure.

FIG. 1 shows a conveyance element 2 (in this case an escalator step) comprising a tread surface 4 and a front surface 6, which runs from the tread surface 4 to a lower edge 8. Two pairs of belt connection structures, each pair comprising a first belt connection structure 12 and a second belt connection structure 14, extend from the lower edge 8. As explained in more detail below, each pair of first and second belt connection structures 12, 14 is arranged to connect the conveyance element 2 to a drive belt (not shown in FIG. 1). Whilst the conveyance element 2 in FIG. 1 has two pairs of first and second belt connection structures 12, 14 this is not essential. In some (unillustrated) examples, the conveyance element may comprise only one first belt connection structure 12 and one second belt connection structure 14.

The tread surface 4 extends from the front surface 6 to a rear edge 16. Two step rollers 18 are connected to the conveyance element 2 near the rear edge, with one step roller 18 at each side of the rear edge 16 (only one step roller 18 is visible in FIG. 1).

The first and second belt connection structures 12, 14 each comprise a bearing 20 (e.g. a roller bearing). These enable a drive belt (not shown) to be rotatably connected to the conveyance element 2.

Figure 2:
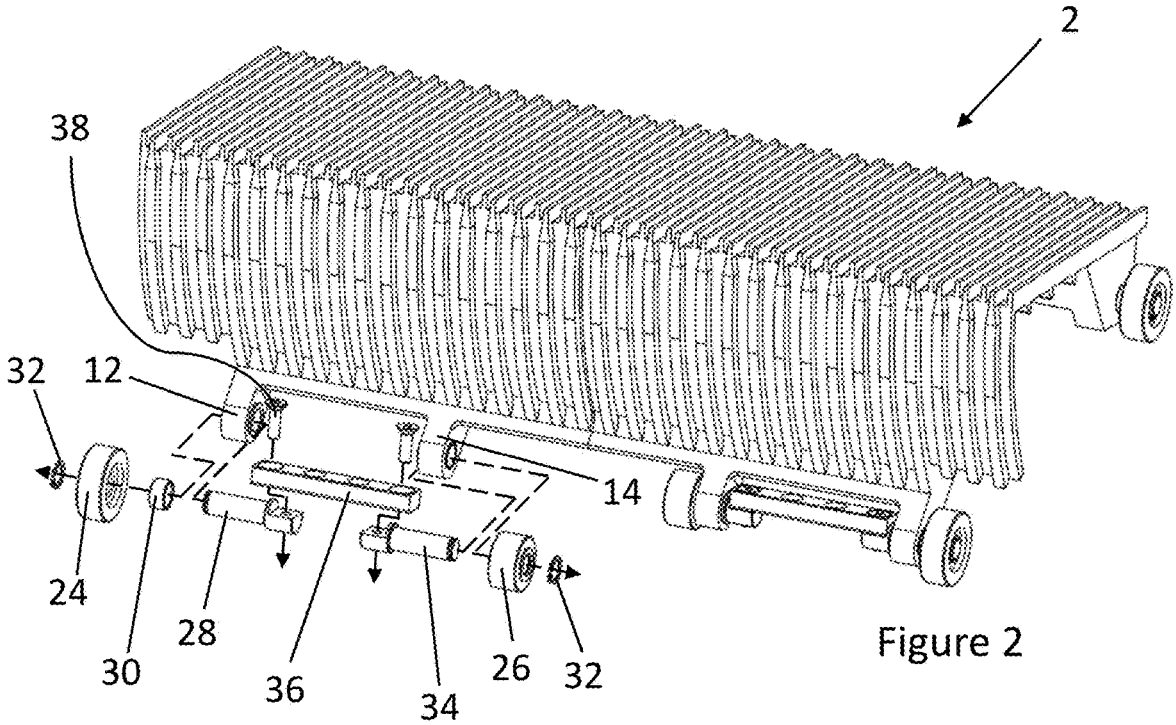
FIG. 2 is a partially exploded view of the conveyance element with belt connection structure.
Figure 3:
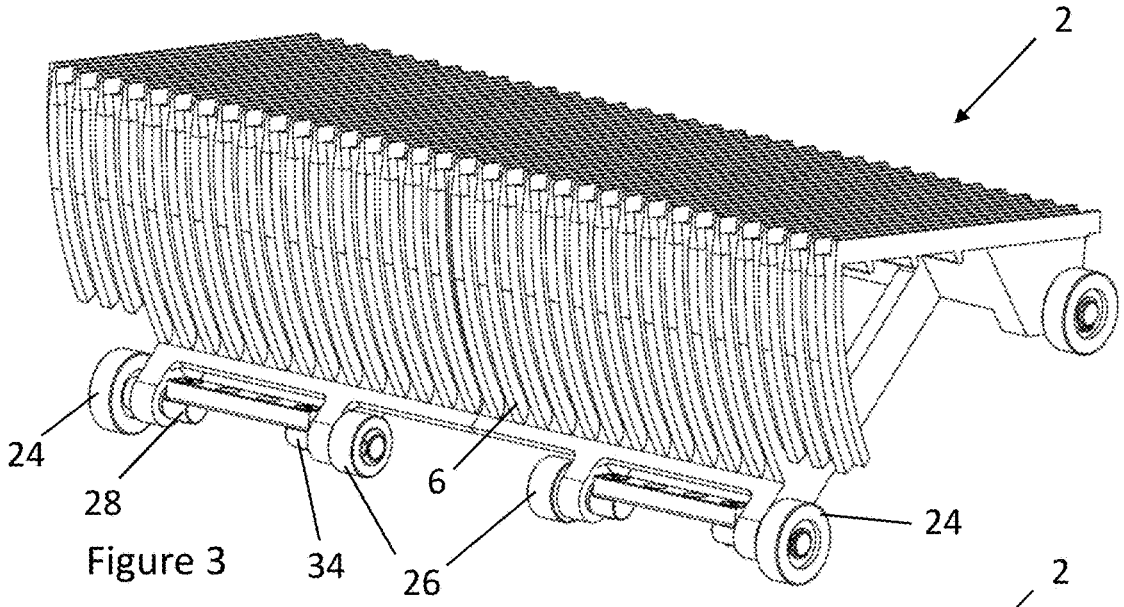
FIGS. 3, 4 and 5 show various further views of the conveyance element with belt connection structure.
Figure 4:
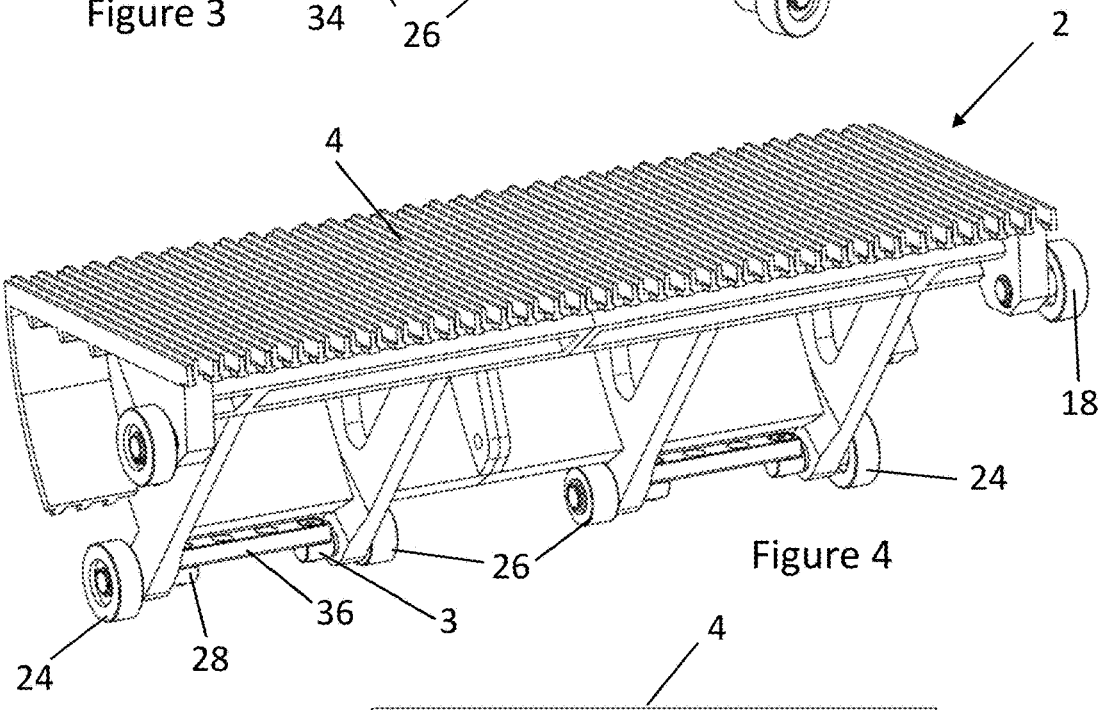
Figure 5:
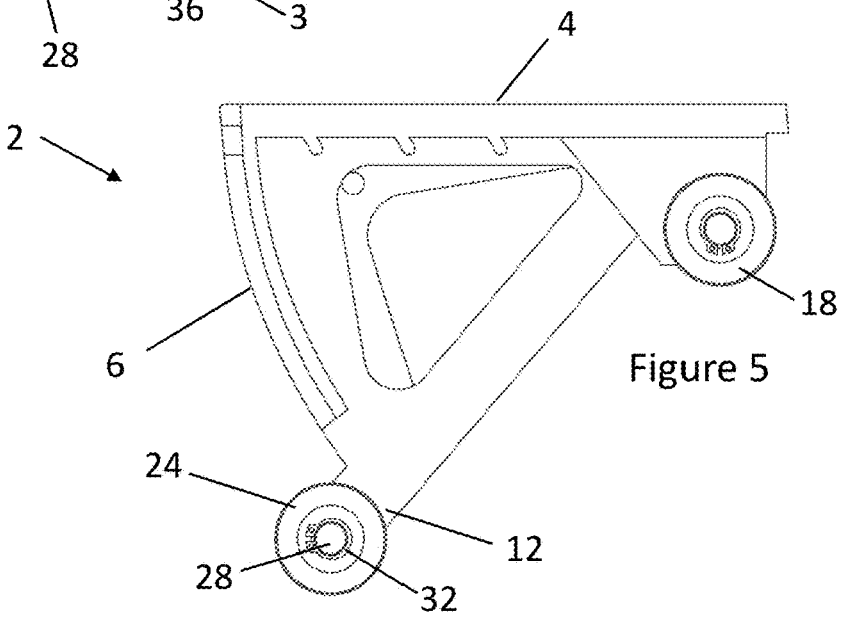

FIG. 2 shows a partially exploded view of the conveyance element 2. First belt rollers 24 are connected to the conveyance element 2 via the first belt connection structures 12. Second belt rollers 26 are connected to the second belt connection structures 14. FIGS. 3, 4 and 5 show additional views of the conveyance element 2 with the belt rollers 24, 26 connected.

As can be seen most clearly in FIG. 2, each first belt roller 24 is connected to the first belt connection structure 12 via a first axle 28 (which passes through the bearing 20 of the first connection structure 12) and a belt roller bearing 30 that is positioned between the first belt roller 24 and the axle 28, enabling free rotation of the first support roller 24 and the axle 28. The first belt rollers 24 are held in place with a circlip 32. Similarly, the second belt rollers 26 are connected to the second belt connection structures 14 via second axles 34 and held in place with a circlip 32. The second belt rollers 26 are not, however, connected via a bearing and instead the second belt rollers 26 sit directly on the second axles 34 (i.e. acting as a bushing).

FIG. 2 also shows a belt connection member 36, which is rigidly connected via bolts 38 to the first and second axles 28, 34. An assembled conveyance element 2, with first and second support rollers 24, 26 and belt connection members 36 connected thereto is shown in FIGS. 3, 4 and 5. The belt connection member 36, in conjunction with the first and second belt connection structures 12, 14, may be used to connect the conveyance element 2 to a drive belt (not shown in FIG. 2).

Figure 6:
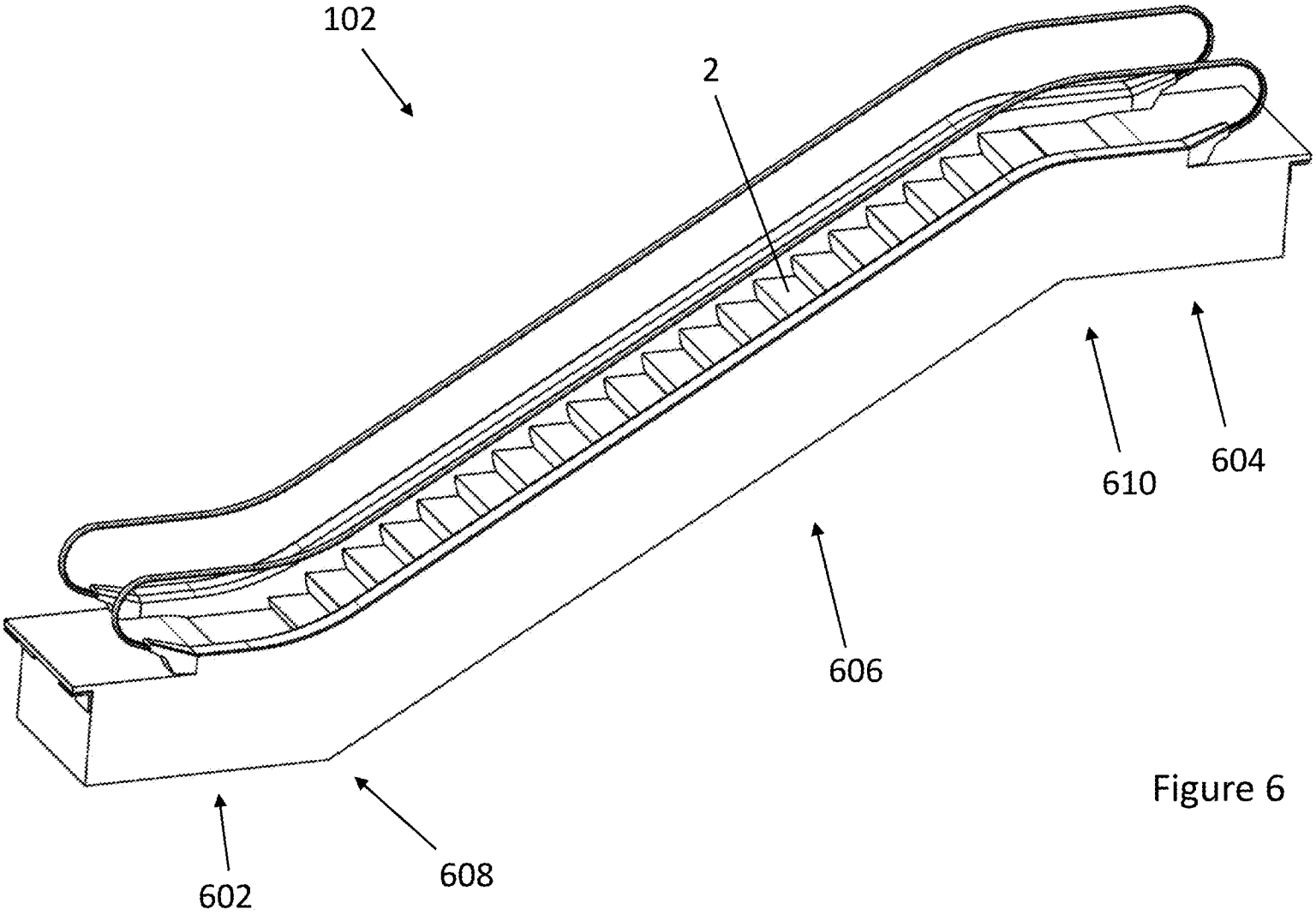
FIG. 6 shows a people conveyor according to an example of the present disclosure.

FIG. 6 shows a people conveyor 102 (in this case an escalator) comprising a plurality of conveyance elements 2. The people conveyor 102 comprises a lower landing region 602, an upper landing region 604 and an inclined region 606 located between the landing regions 602, 604. The people conveyor 102 comprises transition regions 608, 610 between the inclined region 606 and the landing regions 602, 604, in which the conveyance elements 2 transition from travelling at an incline to travelling parallel to the ground in the non-inclined landing regions 602, 604.

Figure 7:
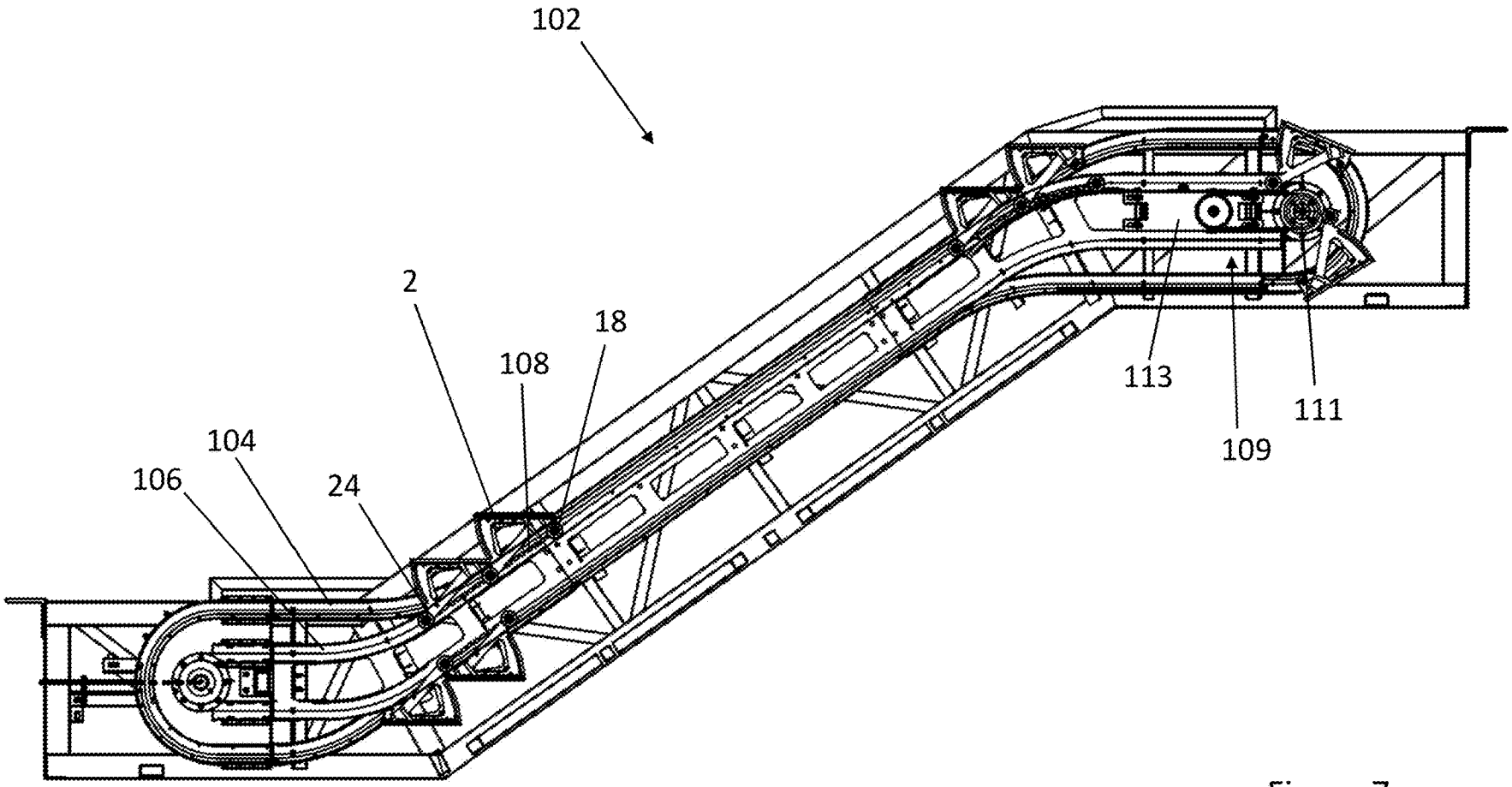
FIG. 7 is a cross section of the people conveyor.

FIG. 7 shows a side cross-section view of the people conveyor 102. To aid clarity, FIG. 7 shows the people conveyor 102 with only a subset of the conveyance elements 2 connected. Although only one can be seen in the cross section of FIG. 7, the people conveyor 102 comprises two step tracks 104 on which the step rollers 18 of the conveyance elements 2 travel. Similarly, the people conveyor 102 also comprises two first support tracks 106 on which the first belt rollers 24 of the conveyance element 2 travel.

As is shown more clearly in FIG. 8 (described below), each conveyance element 2 is connected to two drive belts 108 (one per pair of first and second belt connection structures 12, 14, with only one belt shown in FIG. 7). Each drive belt 108 is coupled to a drive sprocket 111 of a direct drive system 109, located underneath the upper landing region 604. The drive system 109 comprises one or more drive motors 113 that rotate the drive sprockets 111 (e.g. a shared motor for both sprockets 111 or a separate motor for each sprocket). The rotation of the drive sprockets 111 provides a drive force to the drive belts 108 to propel the conveyance elements 2 along the step and first support tracks 104, 106, thus conveying passengers.

Figure 8:
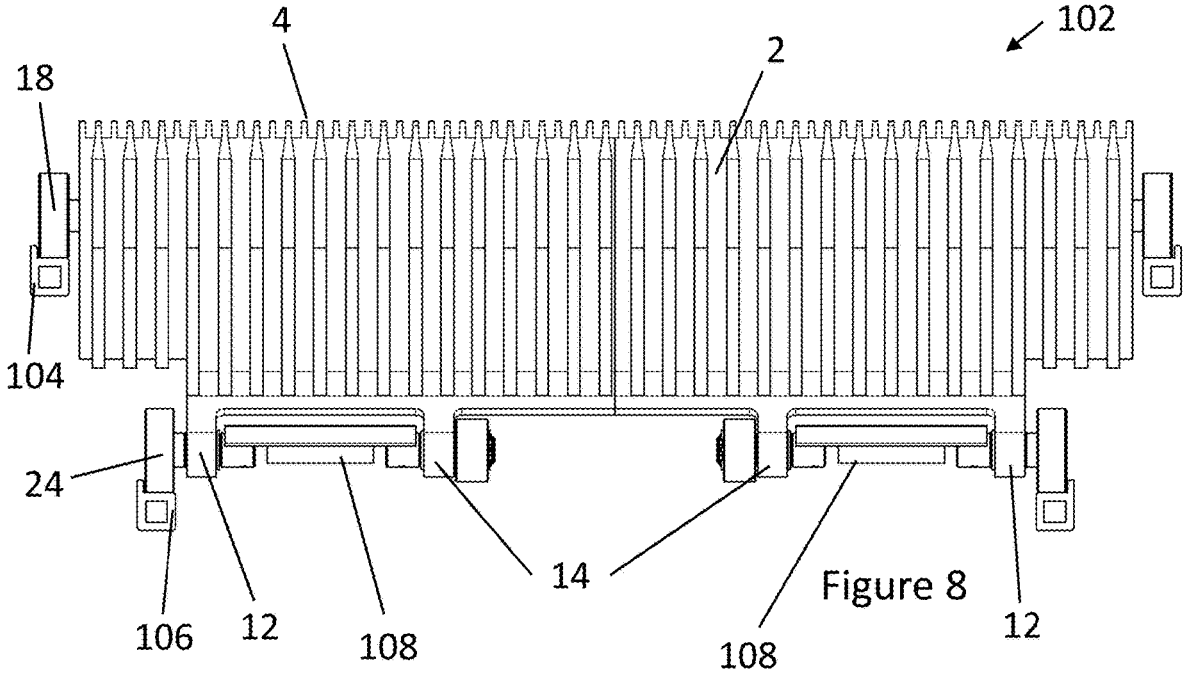
FIG. 8 shows another view of the people conveyor.

FIG. 8 is another view of the people conveyor 102, showing the front of a conveyance element 2 and a cross section through the step tracks 104 and first support tracks 106. Because each drive belt 108 is connected to the conveyance element 2 via the bearings 20 of the first and second belt connection structures 12, 14, the drive belt 108 is able to rotate relative to the passenger conveyance element 2 about an axis running between the first and second belt connection structures 12, 14 (i.e. perpendicular to the direction of drive but parallel to the tread surface 4).

Figure 9:
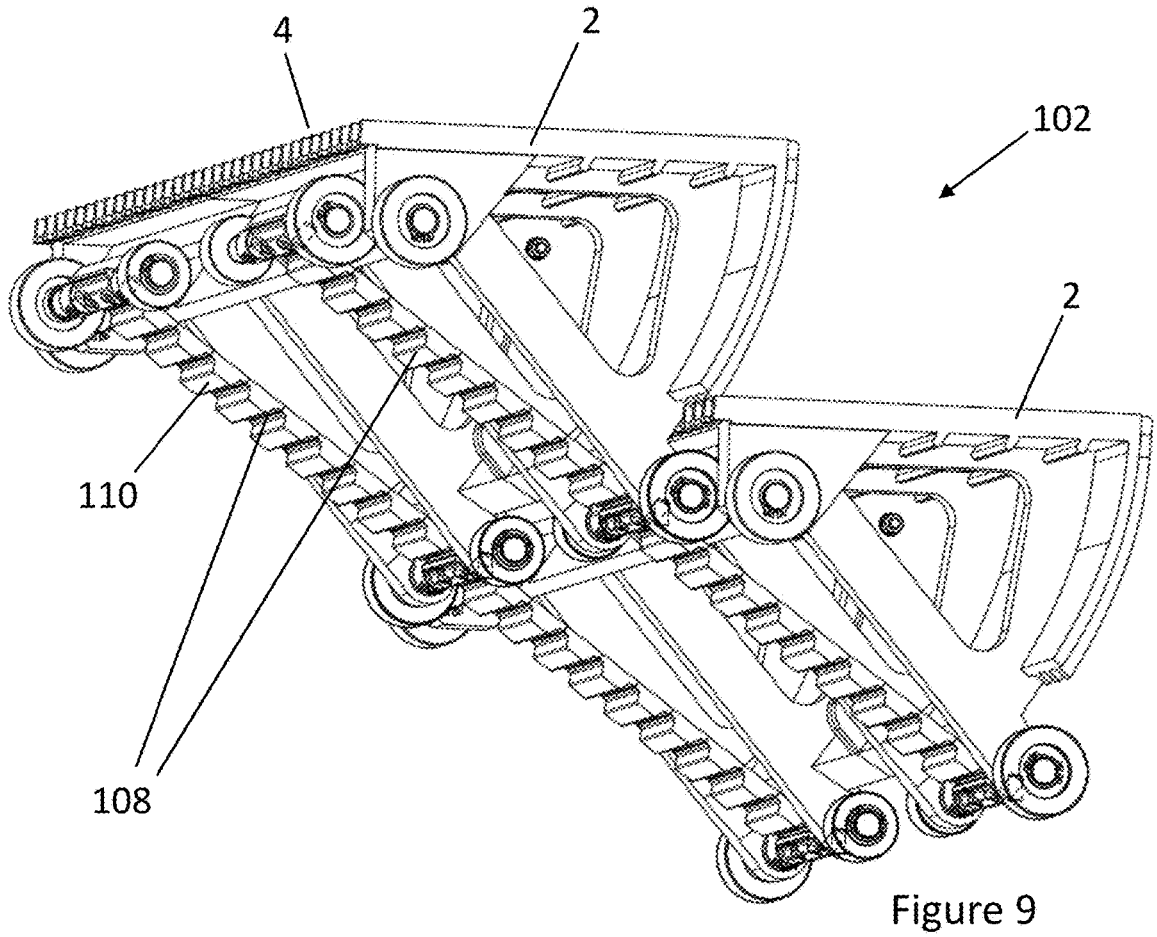
FIGS. 9 and 10 show an inclined region of the people conveyor.
Figure 10:
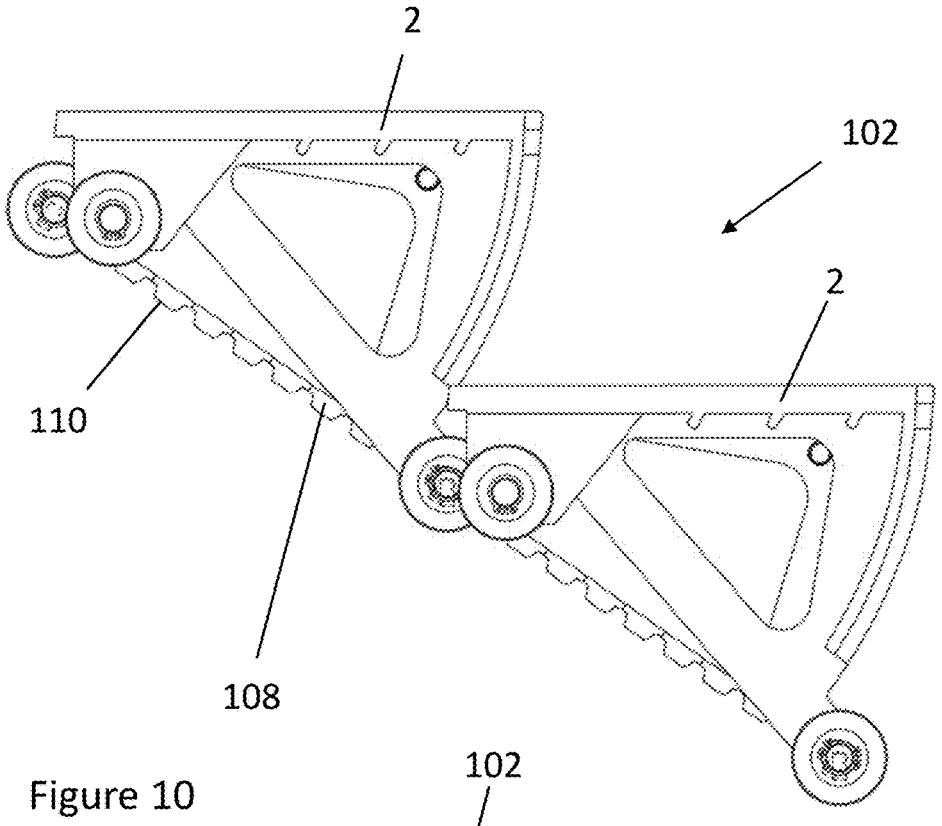

FIG. 9 provides an alternative view of the people conveyor 102 showing two adjacent conveyance elements 2 connected to drive belts 108. FIG. 10 is a side view of the people conveyor 102 shown in FIG. 9. The step and support tracks are omitted from FIGS. 7 and 8 for clarity. The drive belts 108 each comprise a plurality of teeth 110 (ten per conveyance element 2), for engagement with the drive system 109. The inclined region of the people conveyor 102 is shown in FIGS. 9 and 10. The tread surfaces 4 of the conveyance elements 2 are horizontally oriented.

Figure 11:
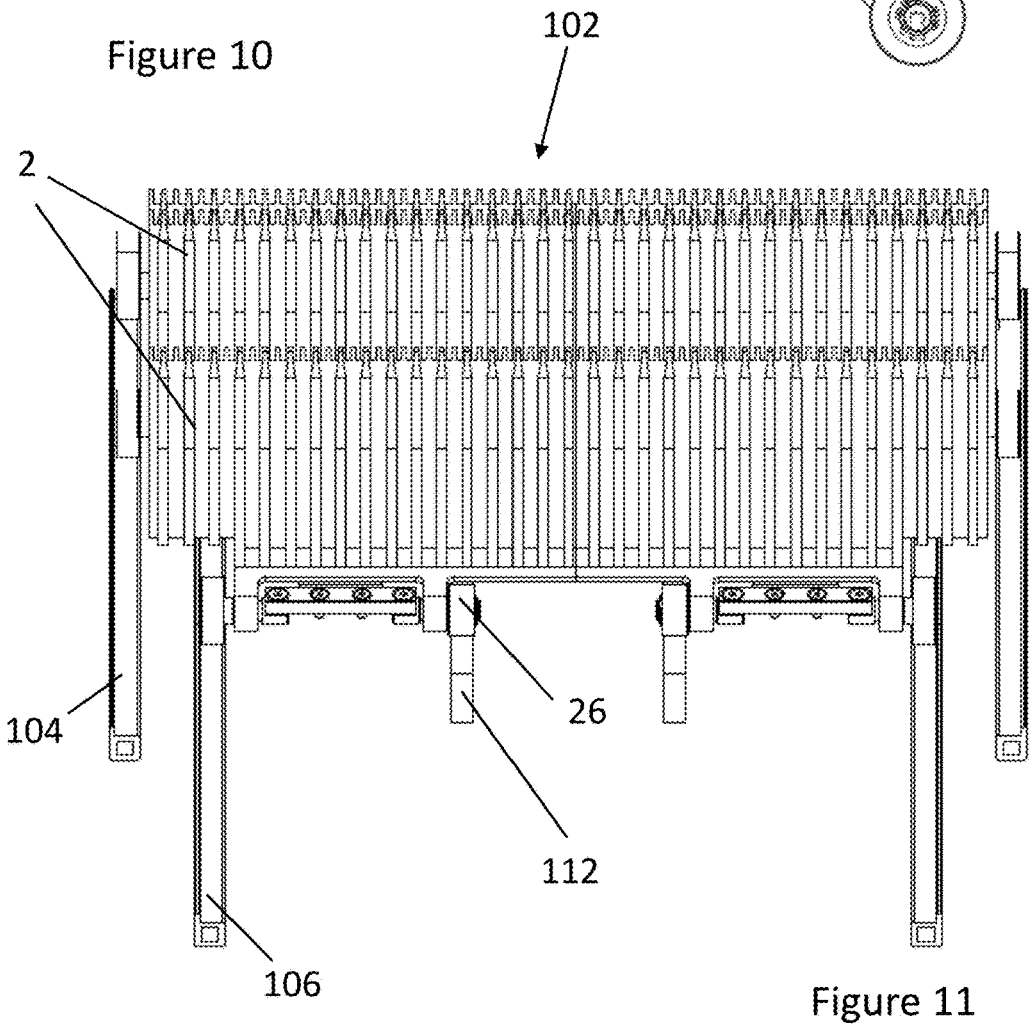
FIGS. 11, 12 and 13 show a transition region of the people conveyor.

FIG. 11 shows a front view of the transition region of the people conveyor 102. As in FIG. 8, the conveyance elements 2 are supported on a step track 104 and on first support tracks 106. However, in the transition region the people conveyor 102 further comprises second support tracks 112, on which the second belt rollers 26 of the conveyance element 2 travel. The second support tracks 112 are provided in the transition region to provide additional support to the conveyance elements 2 (via the second belt rollers 26).

Figure 12:
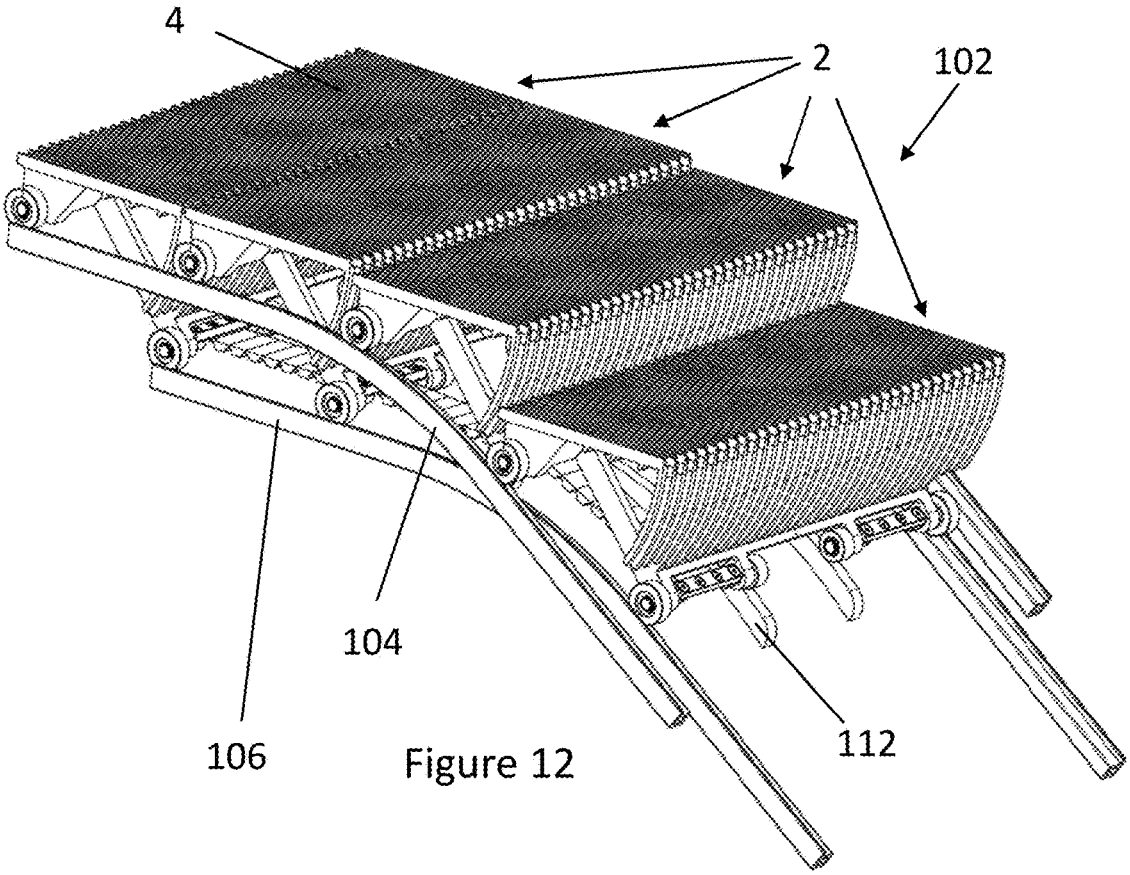

FIG. 12 shows an alternative view of the transition region of the people conveyor 102, in this case showing four conveyance elements 2. The conveyance elements are supported on the step tracks 104 and the first and second support tracks 106, 112. FIG. 12 shows how the step tracks 104 and the first and second support tracks 106, 112 curve to provide a smooth transition between the inclined region and the landing region of the people conveyor 102. It can also be seen from FIG. 12 that the second support tracks 112 do not extend beyond the transition region (as the additional support they provide is not required in this example outside of this region).

Figure 13:
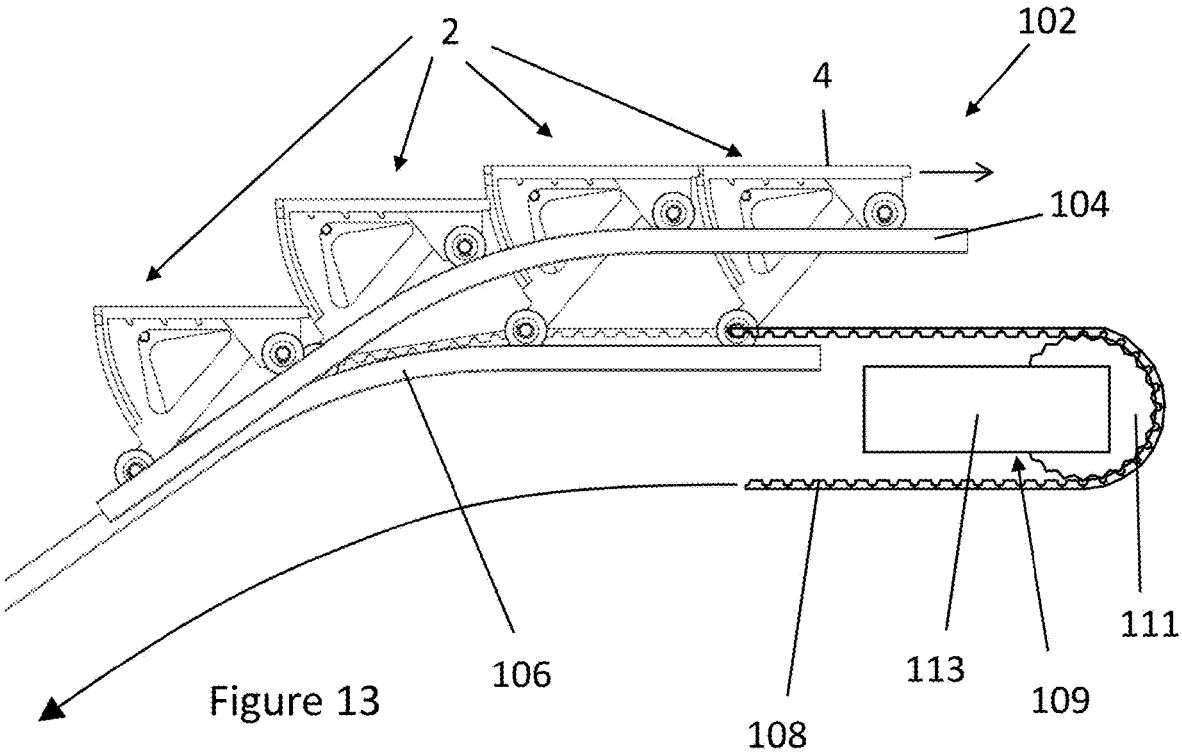

FIG. 13 is a side view of the transition region of the people conveyor 102. FIG. 13 also shows in more detail the direct drive system 109 comprising the drive motor 113 and the drive sprocket 111. The direct drive system 109 is located beneath the upper landing region 604 of the people conveyor 102 and is thus very space efficient as it does not add to the overall footprint of the people conveyor 102. This is enabled by the use of belts 108 rather than the traditional step chain as the sprocket 111 can be of much reduced size. In this particular example, the sprocket 111 has a diameter of 275 mm and has 22 teeth.

In the examples described above, only one first belt roller 24 and one second belt roller 26 is provided per drive belt 108 per conveyance element 2. However, as shown in FIGS. 14 and 15, in some examples intermediate first and second belt rollers 224, 226 may be provided, connected to the drive belt 108 between the first and second belt rollers 24, 26 of adjacent conveyance elements 2 (in this case approximately halfway between first and second belt rollers 24, 26 of adjacent conveyance elements 2). In this example one pair of intermediate first and second belt rollers 224, 226 is provided per conveyance element 2 but further intermediate first and/or second belt rollers may be provided if required. Providing additional belt rollers over which the load of the people conveyor is spread may reduce the forces experienced by each individual belt roller. The intermediate belt rollers 224, 226 may also help to reduce bending forces on the drive belt 108 in the transition regions by reducing the distance between points of support of the drive belt 108. This can be seen when FIG. 15 is compared to FIG. 13, in which no intermediate rollers are provided and the change in direction of the drive belt 108 at each point of support (i.e. each belt roller 24) is more severe.

While the disclosure has been described in detail in connection with only a limited number of examples, it should be readily understood that the disclosure is not limited to such disclosed examples. Rather, the disclosure can be modified to incorporate any number of variations, alterations, substitutions or equivalent arrangements not heretofore described, but which are commensurate with the scope of the disclosure. Additionally, while various examples of the disclosure have been described, it is to be understood that aspects of the disclosure may include only some of the described examples. Accordingly, the disclosure is not to be seen as limited by the foregoing description, but is only limited by the scope of the appended claims.

What is claimed is:

1. A conveyance element for a belt-driven people conveyor comprising:

a first belt connection structure arranged to connect a drive belt to the conveyance element; and a second belt connection structure arranged to connect the drive belt to the conveyance element;

wherein the first and second belt connection structures are arranged such that, when connected, the drive belt passes adjacent to and between the first and second belt connection structures;

wherein the first belt connection structure includes a first belt connection member configured to connect the drive belt to the conveyance element;

wherein the second belt connection structure includes a second belt connection member configured to connect the drive belt to the conveyance element;

wherein the first belt connection member and the second belt connection member are separate elements.

2. The conveyance element of claim 1, wherein the first and/or second belt connection structures are arranged to rotatably connect the drive belt to the conveyance element.

3. The conveyance element of claim 1, wherein the first and/or second belt connection structure extends from a lower edge of the conveyance element.

4. The conveyance element of claim 1, further comprising a first support component arranged to support the conveyance element on a first support track of the people conveyor.

5. The conveyance element of claim 4, wherein the first support component is connected to the first belt connection structure.

6. The conveyance element of claim 4, further comprising a second support component arranged to support the conveyance element on a second support track of the people conveyor.

7. The conveyance element of claim 4, wherein the second support component is connected to the second belt connection structure.

8. The conveyance element of claim 6, wherein the first support component comprises a first belt roller connected to the first belt connection structure via a bearing and the second support component comprises a second belt roller connected to the second belt connection structure via a bushing.

9. A conveyance element for a belt-driven people conveyor comprising:

a first belt connection structure arranged to connect a drive belt to the conveyance element; and a second belt connection structure arranged to connect the drive belt to the conveyance element;

wherein the first and second belt connection structures are arranged such that, when connected, the drive belt passes adjacent to and between the first and second belt connection structures;

the first belt connection structure and the second belt connection structure comprising two pairs of first and second belt connection structures, each pair arranged to connect a drive belt to the conveyance element such that, when connected, each drive belt passes adjacent to and between the first and second belt connection structures with which it is connected to the conveyance element.

10. A belt-driven people conveyor comprising:

a plurality of conveyance elements each comprising first and second belt connection structures; and a drive belt connected to the plurality of conveyance elements via the first and second belt connection structures, wherein the drive belt passes adjacent to and between the first and second belt connection structures;

wherein the first belt connection structure includes a first belt connection member configured to connect the drive belt to the conveyance element;

wherein the second belt connection structure includes a second belt connection member configured to connect the drive belt to the conveyance element;

wherein the first belt connection member and the second belt connection member are separate elements.

11. The belt-driven people conveyor of claim 10, further comprising a direct drive system arranged to drive the drive belt so as to propel the plurality of conveyance elements.

12. The belt-driven people conveyor of claim 10, further comprising at least one first support track, wherein each of the plurality of conveyance elements comprises at least one first support component arranged to support the conveyance element on the at least one first support track.

13. The belt-driven people conveyor of claim 12, further comprising at least one second support track, wherein each of the plurality of conveyance elements comprises at least one second support component arranged to support the conveyance element on the at least one second support track.

14. The belt-driven people conveyor of claim 13, with a conveyance path comprising:

an inclined region;

a landing region; and a transition region between the inclined region and the landing region;

wherein the second support track extends substantially in only the transition region.

* * * * *